US007845531B2

(12) United States Patent
Yeh et al.

(10) Patent No.: US 7,845,531 B2
(45) Date of Patent: Dec. 7, 2010

(54) STAPLER MODULE AND MULTI-FUNCTION PERIPHERAL HAVING THE SAME

(75) Inventors: Tso-Li Yeh, Taipei County (TW); Ming-Chih Huang, Taipei County (TW)

(73) Assignee: Kinpo Electronics, Inc., Taipei County (TW)

( * ) Notice: Subject to any disclaimer, the term of this patent is extended or adjusted under 35 U.S.C. 154(b) by 90 days.

(21) Appl. No.: 12/421,839

(22) Filed: Apr. 10, 2009

(65) Prior Publication Data

US 2010/0258610 A1 Oct. 14, 2010

(51) Int. Cl.
*B27F 7/00* (2006.01)

(52) U.S. Cl. ..... 227/107; 227/78

(58) Field of Classification Search ..... 270/58.01, 270/59, 37; 227/78, 107
See application file for complete search history.

(56) References Cited

U.S. PATENT DOCUMENTS 4,318,555 A * 3/1982 Adamski et al. ..... 227/7
4,376,529 A * 3/1983 George et al. ..... 270/58.16
4,410,170 A * 10/1983 Wertheimer et al. ..... 270/37
4,687,191 A * 8/1987 Stemmle ..... 270/58.15
4,886,259 A * 12/1989 Ishikawa et al. ..... 270/58.15
4,928,941 A * 5/1990 Uto et al. ..... 270/58.14
5,398,918 A 3/1995 Rizzolo et al.
5,836,578 A * 11/1998 Hirano et al. ..... 270/58.11
H1842 H * 3/2000 Tontarski ..... 227/100
6,283,354 B1 * 9/2001 Hirota et al. ..... 227/39

* cited by examiner

*Primary Examiner*—Brian D Nash
(74) *Attorney, Agent, or Firm*—J.C. Patents

(57) ABSTRACT

A multi-function peripheral includes a main body and a stapler module for stapling papers. The stapler module includes a fixed structure disposed in the main body, a motor fixed to the fixed structure, a driving set, two staplers, and two anvils fixed to the fixed structure. The driving set includes a transmitting structure coupled to the motor and two connecting parts coupled to two ends of the transmitting structure, respectively. The staplers connect the connecting parts, respectively. The motor drives the connecting parts to move toward or away from the anvils through the transmitting structure and, therefore, a first distance or a second distance is between the staplers and the anvils. When the first distance is between the staplers and the anvils, the staplers staple the papers. When the second distance is between the staplers and the anvils, a paper feeding path is defined between the staplers and the anvils.

10 Claims, 7 Drawing Sheets

STAPLER MODULE AND MULTI-FUNCTION PERIPHERAL HAVING THE SAME

BACKGROUND OF THE INVENTION

1. Field of the Invention

The present invention generally relates to a stapler module and a multi-function peripheral having the same, in particular, to a movable stapler module a multi-function peripheral having the same.

2. Description of Related Art

In the informationization society, automatic apparatuses such as scanners, photocopiers or printers are set in the office. Users may process documents by using the automatic apparatuses. It is mentionable that much space is necessary if a number of said automatic apparatuses are all set up in the office. Therefore, a multi-function peripheral (MPF) integrating functions of copying, printing, and scanning is developed for resolving said problems.

Users usually place a stack of papers on the multi-function peripheral while copying, printing, or scanning. Meanwhile, the multi-function peripheral may further include a stapler module for stapling the papers after the papers are copied or printed. In general, the stapler module at least has a stapler and an anvil, and a proper gap is between the stapler and the anvil for placing the papers therebetween. While the copied or printed papers are transmitted to the gap between the stapler and the anvil and held by the anvil, the stapler staples the papers. The gap between the stapler and the anvil must be small enough, such that the stapler can staple the papers on the anvil properly. However, since the gap is too small, the papers are likely to contact the stapler or the anvil, such that the papers are not fed smoothly when the papers are fed to the gap between the stapler and the anvil.

SUMMARY OF THE INVENTION

Accordingly, the present invention is directed to a stapler module for feeding papers in a smooth manner.

The present invention is further directed to a multi-function peripheral having stapler module for making the feeding of the papers more fluent.

The present invention provides a stapler module for stapling a plurality of papers. The stapler module comprises a fixing structure, a driving set, two staplers, and two anvils. The driving set comprises a motor, a transmitting structure, and two connecting parts. The motor is fixed to the fixing structure. The transmitting structure is coupled to the motor. The two connecting parts are respectively coupled to two ends of the transmitting structure. The two staplers are respectively connected to the two connecting parts. The anvils are fixed to the fixing structure and respectively correspond to the two staplers. The two connecting parts are driven by the motor to move toward or away from the two anvils through the transmitting structure, such that a first distance or a second distance longer than the first distance is between each of the staplers and the corresponding anvil. The two staplers staple the papers while the first distance is between each of the staplers and the corresponding anvil, and the papers are moved along a paper feeding path defined between the two staplers and the two anvils while the second distance is between each of the staplers and the corresponding anvil.

The present invention further provides a multi-function peripheral comprising a main body and a stapler module. The stapler module is used for stapling a plurality of papers. The stapler module comprises a fixing structure, a driving set, two staplers, and two anvils. The fixing structure is disposed in the main body. The driving set comprises a motor, a transmitting structure and two connecting parts. The motor is fixed to the fixing structure. The transmitting structure is coupled to the motor. The two connecting parts are respectively coupled to two ends of the transmitting structure. The two staplers are respectively connected to the two connecting parts. The anvils are fixed to the fixing structure and respectively correspond to the two staplers. The two connecting parts are driven by the motor to move toward or away from the two anvils through the transmitting structure, such that a first distance or a second distance longer than the first distance is between each of the staplers and the corresponding anvil. The two staplers staple the papers while the first distance is between each of the staplers and the corresponding anvil, and the papers are moved along a paper feeding path defined between the two staplers and the two anvils while the second distance is between each of the staplers and the corresponding anvil.

In an embodiment of the present invention, the transmitting structure comprises a worm gear, a bevel gear, a driving rod, and two connecting rod sets. The worm gear is connected to the motor. The bevel gear is engaged to the worm gear. The driving rod is connected to the bevel gear. The two connecting rod sets are respectively connected to two ends of the driving rod and respectively coupled to the two connecting parts, wherein the motor is used for driving the worm gear and the bevel gear to rotate, such that the driving rod respectively drives the two connecting parts to move toward or away from the two anvils through the two connecting rod sets while the bevel gear is rotated.

In an embodiment of the present invention, each of the two ends of the driving rod has a spiral portion respectively corresponding to the two connecting rod sets, and each of the connecting rod sets comprises a first rod, a second rod, and a third rod. The first rod has a threaded hole, wherein an end of the first rod is coupled to the corresponding spiral portion through the threaded hole. The two first rods move away from or toward each other along an extending direction of the driving rod while the driving rod drives the two connecting parts to move toward or away from the two anvils through the two connecting rod sets, respectively. The second rod has a first pivoting portion, a second pivoting portion, and a third pivoting portion between the first pivoting portion and the second pivoting portion, wherein the first pivoting portion and the second pivoting portion are respectively coupled to another end of the first rod and the connecting part. The third rod has a fourth pivoting portion, a fifth pivoting portion, and a sixth pivoting portion respectively coupled to the connecting parts, the third pivoting portion, and the fixing structure.

In an embodiment of the present invention, the fixing structure comprises a cover covering at least a part of the driving set.

In an embodiment of the present invention, the paper feeding path is substantially vertical to a moving direction of each of the staplers.

In view of the above, the stapler of the stapler module of the multi-function peripheral according to the present invention can be moved toward or away from the anvils by driving the driving set. The stapler staples the papers while the stapler moves toward the anvil and a shorter distance is between the stapler and the anvil. The probability that the papers contact the stapler or the anvil when the papers are fed to a gap between the stapler and the anvil is reduced while the stapler moves away from the anvil and a longer distance is between the stapler and the anvil, and the papers are fed more smoothly.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
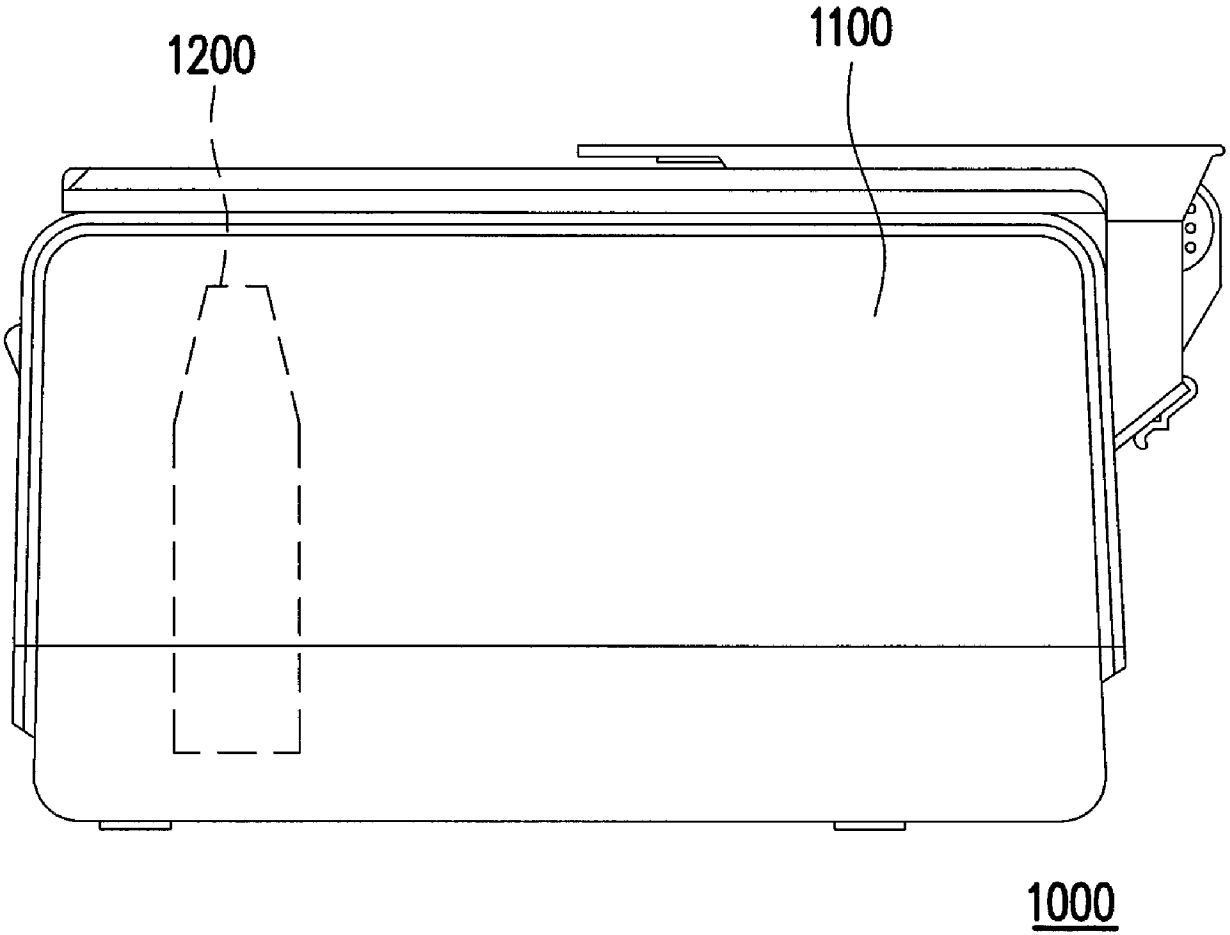
FIG. 1 is a schematic side view of a multi-function peripheral of an embodiment according to the present invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
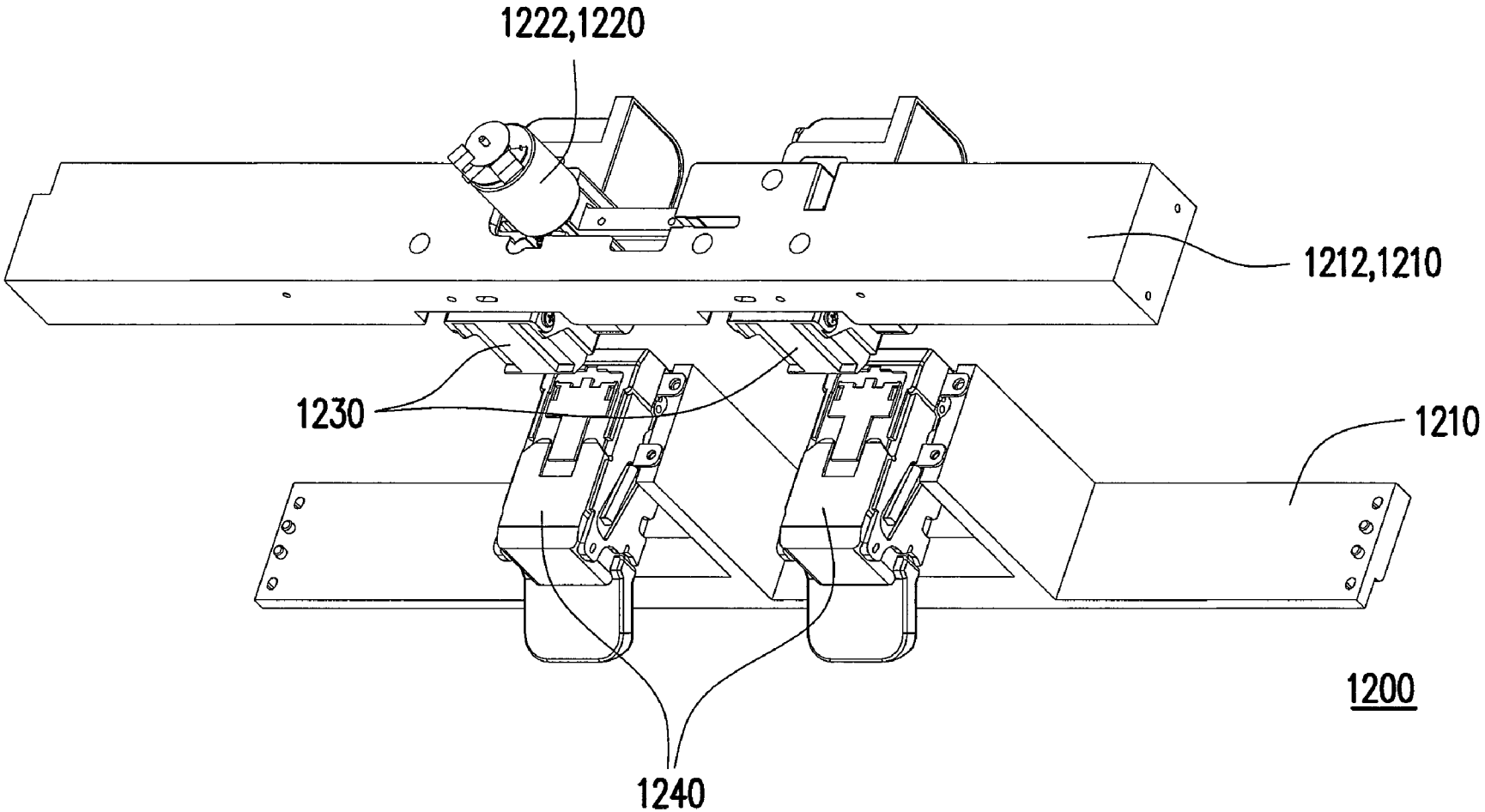
FIG. 2 is a 3D view of the stapler module in FIG. 1.
Figure 3:
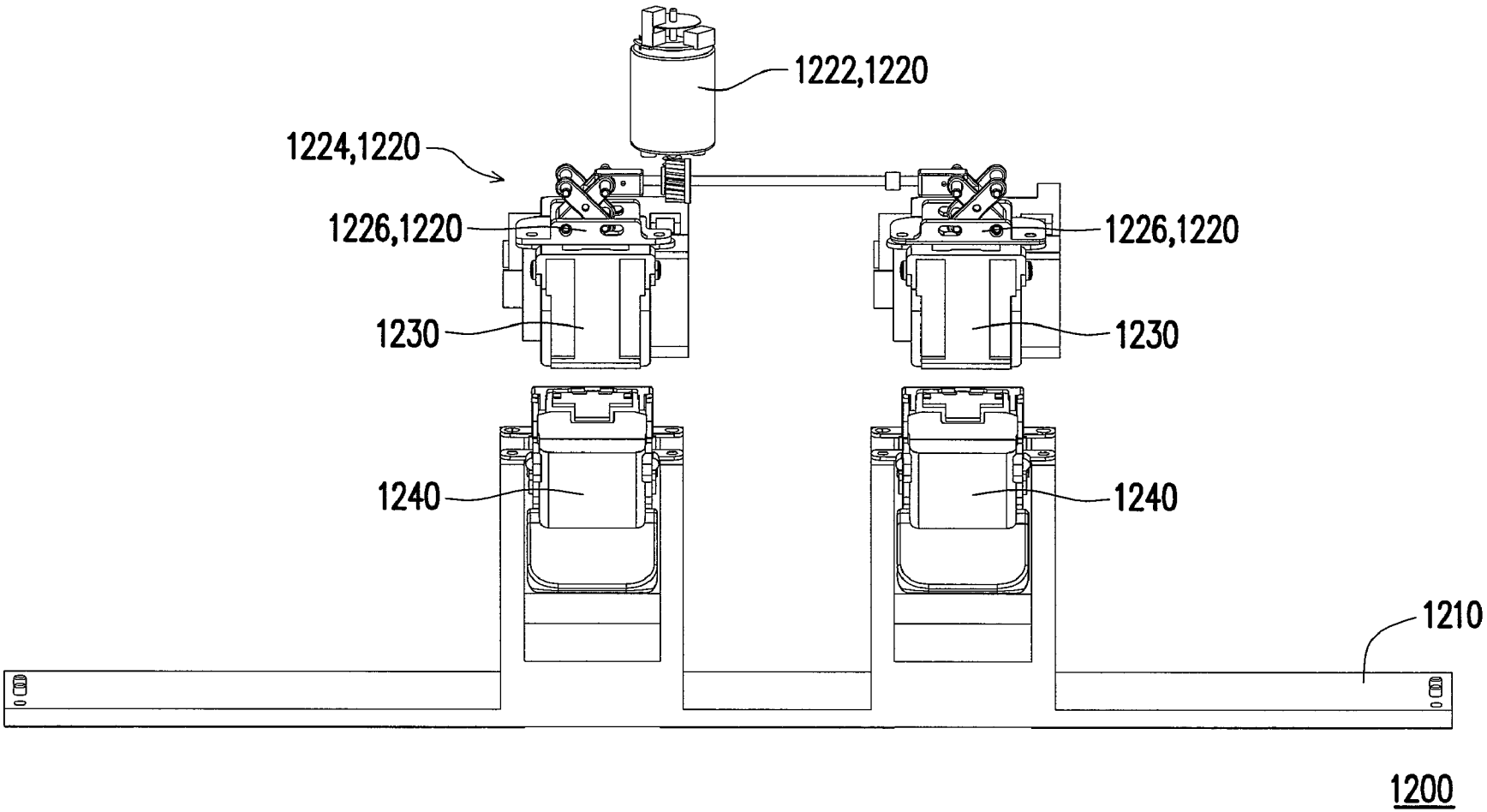
FIG. 3 is a 3D view of a partial structure of the stapler module in FIG. 1.

FIG. 1 is a schematic side view of a multi-function peripheral of an embodiment according to the present invention. FIG. 2 is a 3D view of the stapler module in FIG. 1. FIG. 3 is a 3D view of a partial structure of the stapler module in FIG. 1. Referring to FIG. 1, FIG. 2, and FIG. 3, a multi-function peripheral 1000 of this embodiment comprises a main body 1100 and a stapler module 1200. The stapler module 1200 comprises a fixing structure 1210, a driving set 1220, two staplers 1230, and two anvils 1240. In this embodiment, the fixing structure 1210 may comprise a cover 1212 covering at least a part of the driving set 1220 for avoiding structural damage caused by an external force.

The fixing structure 1210 is disposed in the main body 1100. The driving set 1220 comprises a motor 1222, a transmitting structure 1224, and two connecting parts 1226. The motor 1222 is fixed to the fixing structure 1210. The transmitting structure 1224 is coupled to the motor 1222. The two connecting parts 1226 are respectively coupled to two ends of the transmitting structure 1224. The two staplers 1230 are respectively connected to the two connecting parts 1226. The anvils 1240 are fixed to the fixing structure 1210 and respectively correspond to the two staplers 1230.

Figure 4A:
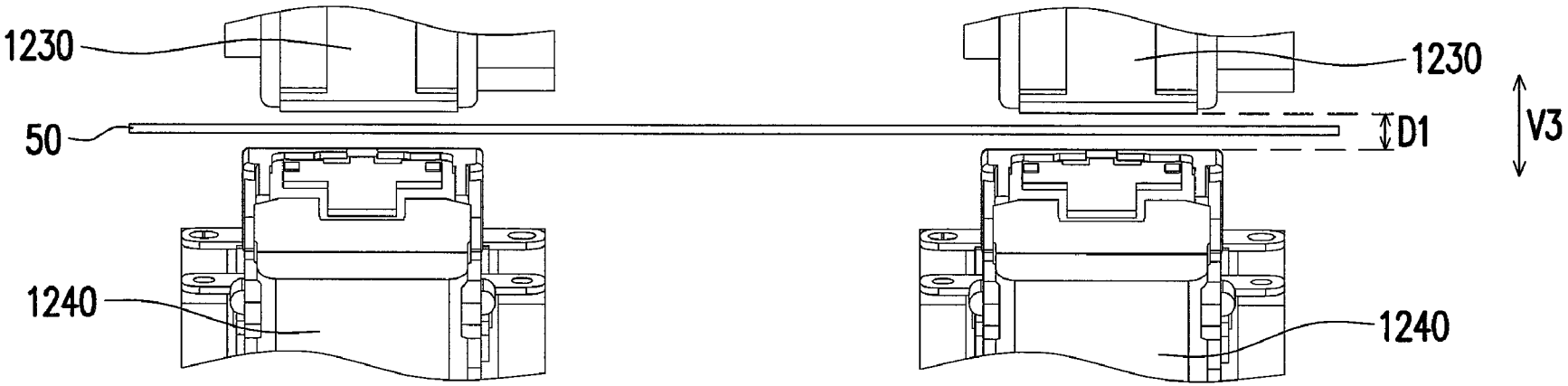
FIG. 4A and FIG. 4B schematically show the actions of the stapler module in FIG. 1.
Figure 4B:
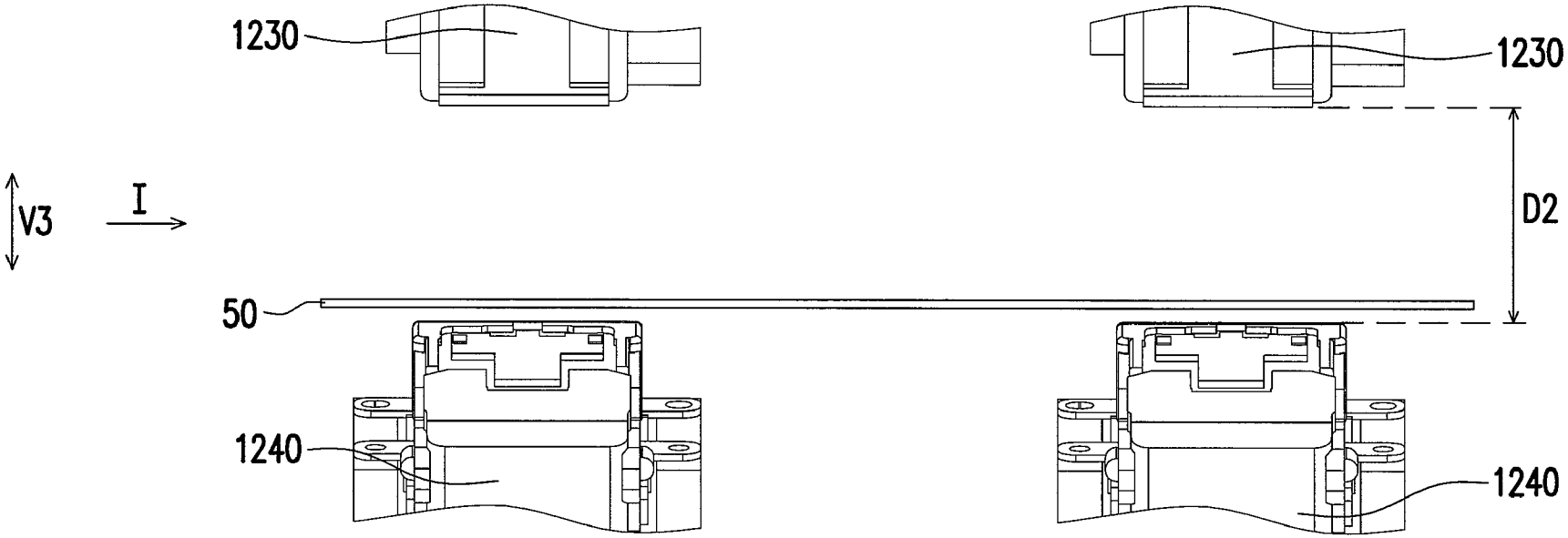
Figure 5:
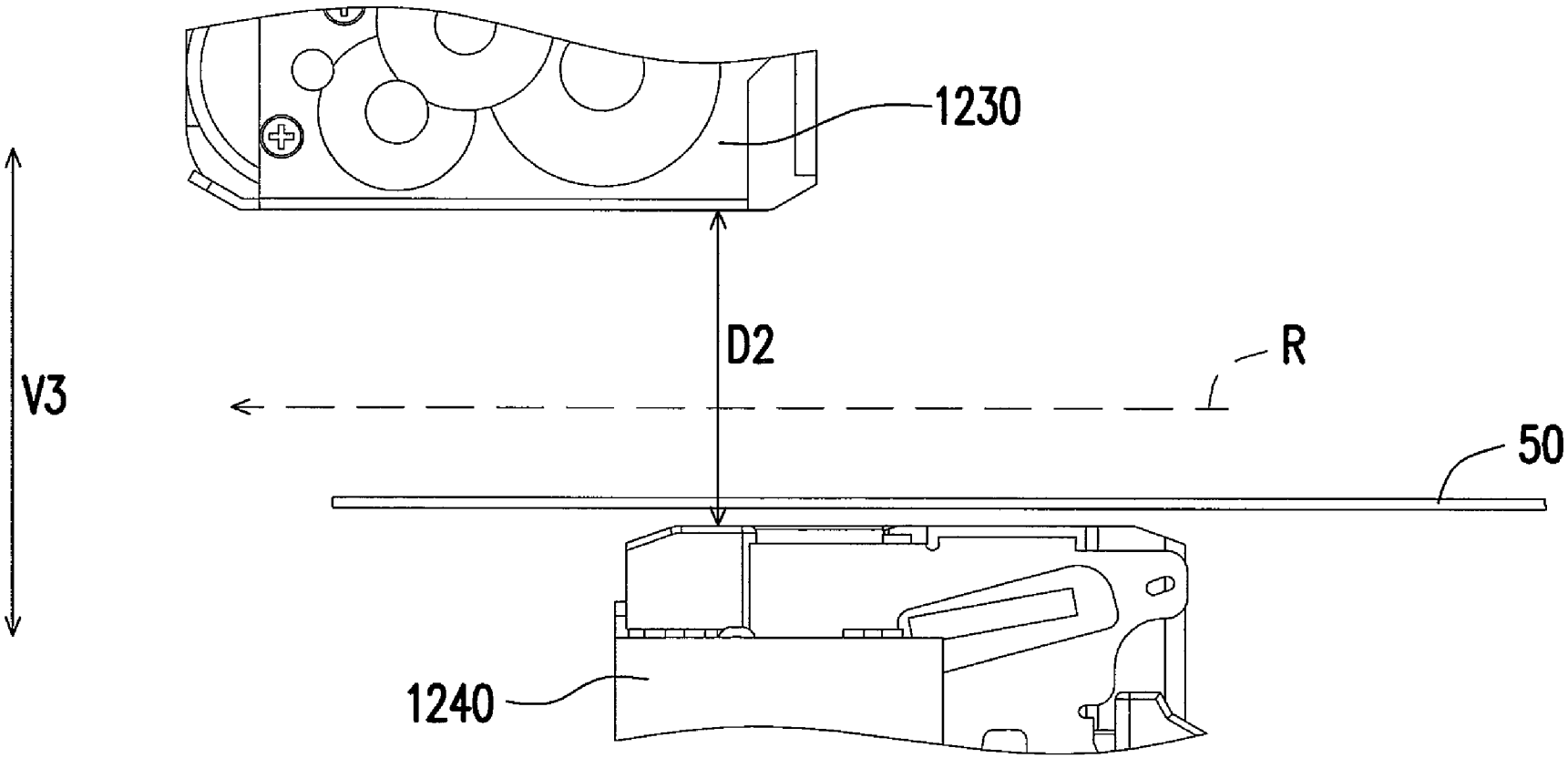
FIG. 5 is a side view of FIG. 4B along a direction I.

FIG. 4A and FIG. 4B schematically show the actions of the stapler module in FIG. 1. FIG. 5 is a side view of FIG. 4B along a direction I. Referring to FIG. 3, FIG. 4A, FIG. 4B, and FIG. 5, the two connecting parts 1226 are driven by the motor 1222 to move toward or away from the two anvils 1240 through the transmitting structure 1224, such that a first distance D1 (as shown in FIG. 4A) or a second distance D2 (as shown in FIG. 4B) longer than the first distance D1 is between each of the staplers 1230 and the corresponding anvil 1240. The two staplers 1230 staple papers 50 while the first distance D1 is between each of the staplers 1230 and the corresponding anvil 1240, and the papers 50 are moved along a paper feeding path R defined between the two staplers 1230 and the two anvils 1240 while the second distance D2 is between each of the staplers 1230 and the corresponding anvil 1240. In this embodiment, the paper feeding path R is substantially vertical to a moving direction V3 of each of the staplers 1230.

In other words, according to this embodiment, the staplers 1230 can move away from or toward the anvils 1240. Therefore, a longer distance D2 between the staplers 1230 and the anvils 1240 can be obtained so as to reduce the probability that the papers 50 contact the staplers 1230 or the anvils 1240 when the papers 50 are moved along the paper feeding path R, and the papers 50 are fed more smoothly. A smaller distance D1 between the staplers 1230 and the anvils 1240 can be obtained while the papers 50 are fed to a gap between the staplers 1230 and the anvils 1240 and held by the anvils 1240 for better stapling the papers 50.

Figure 6:
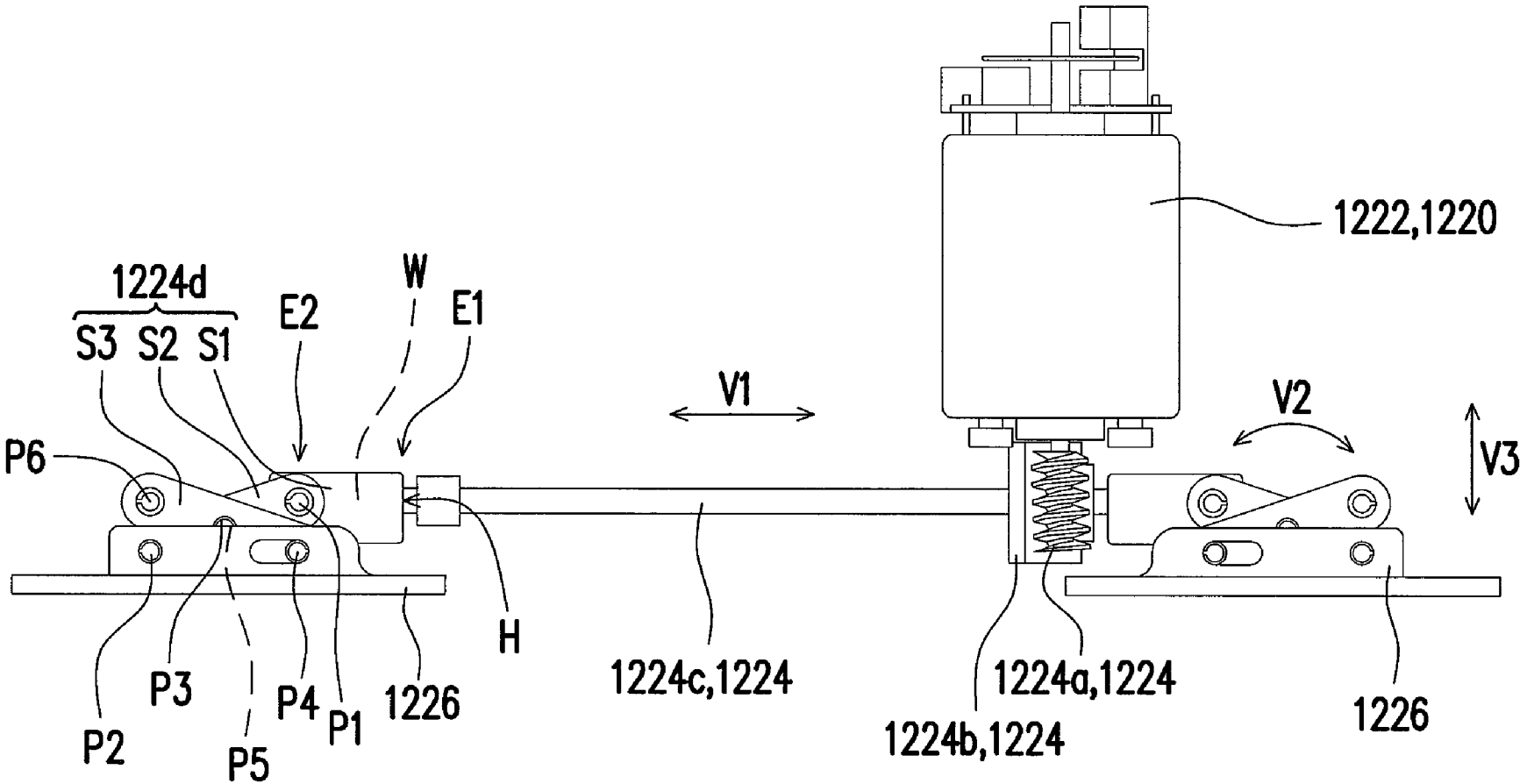
FIG. 6 is a side view of the driving set of FIG. 2.

FIG. 6 is a side view of the driving set of FIG. 2. Referring to FIG. 6, in detail, according to this embodiment, the transmitting structure 1224 comprises a worm gear 1224*a*, a bevel gear 1224*b*, a driving rod 1224*c*, and two connecting rod sets 1224*d*. The worm gear 1224*a* is connected to the motor 1222. The bevel gear 1224*b* is engaged to the worm gear 1224*a*. The driving rod 1224*c* is connected to the bevel gear 1224*b*. The two connecting rod sets 1224*d* are respectively connected to two ends of the driving rod 1224*c* and respectively coupled to the two connecting parts 1226. The motor 1222 is used for driving the worm gear 1224*a* and the bevel gear 1224*b* to rotate, such that the driving rod 1224*c* respectively drives the two connecting parts 1226 to move toward or away from the two anvils 1240 (shown in FIG. 3) through the two connecting rod sets 1224*d* while the bevel gear 1224*b* is rotated.

In more detail, each of the two ends of the driving rod 1224*c* has a spiral portion W respectively corresponding to the two connecting rod sets 1224*d*, and each of the connecting rod sets 1224*d* comprises a first rod S1, a second rod S2, and a third rod S3. The first rod S1 has a threaded hole H, wherein an end E1 of the first rod S1 is coupled to the corresponding spiral portion W through the threaded hole H. The two first rods S1 move away from or toward each other along an extending direction V1 of the driving rod 1224*c* while the driving rod 1224*c* drives the two connecting parts 1226 to move toward or away from the two anvils 1240 through the two connecting rod sets 1224*d*, respectively.

The second rod S2 has a first pivoting portion P1, a second pivoting portion P2, and a third pivoting portion P3 between the first pivoting portion P1 and the second pivoting portion P2, wherein the first pivoting portion P1 and the second pivoting portion P2 are respectively coupled to another end E2 of the first rod S1 and the connecting parts 1226. The third rod S3 has a fourth pivoting portion P4, a fifth pivoting portion P5, and a sixth pivoting portion P6 respectively coupled to the connecting parts 1226, the third pivoting portion P3, and the fixing structure 1210 (as shown in FIG. 2). Each second rod S2 and each third rod S3 are driven to rotate along a direction V2 while the two first rods S1 are moved toward or away from each other along the extending direction V1 of the driving rod 1224*c*, such that the connecting parts 1226 move along the direction V3.

It is notable that the combination of the motor 1222, the worm gear 1224*a*, and the bevel gear 1224*b* in FIG. 6 and the combination of the first rod S1, the second rod S2, and the third rod S3 of the connecting rod set 1224*d* can save effort and reduce the load of the motor 1222. Meanwhile, the movements of the first rods S1 at the two ends of the driving rod 1224*c* in the direction V1 are symmetric and contrary to each other, such that the first rods S1 at the two ends of the driving rod 1224*c* can be counteracted to reduce the load of the motor 1222.

In view of the above, the stapler of the stapler module of the multi-function peripheral according to the present invention can be moved toward or away from the anvil by driving the driving set. The stapler staples the papers while the stapler moves toward the anvil and a shorter distance is between the stapler and the anvil. The probability that the papers contact the stapler or the anvil when the papers are fed to the gap between the stapler and the anvil is reduced while the stapler moves away from the anvil and a longer distance is between the stapler and the anvil, and the papers are fed more smoothly. Meanwhile, the combination of the motor, the worm gear, and the bevel gear or the combination of the first rod, the second rod, and the third rod of the connecting rod set can save effort, reduce the load of the motor, and increase lifespan of the motor.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A stapler module for stapling a plurality of papers, the stapler module comprising:

a fixing structure;

a driving set, comprising:

a motor, fixed to the fixing structure;

a transmitting structure, coupled to the motor;

two connecting parts, respectively coupled to two ends of the transmitting structure;

two staplers, respectively connected to the two connecting parts; and two anvils, fixed to the fixing structure and respectively corresponding to the two staplers, the two connecting parts being driven by the motor to move toward or away from the two anvils through the transmitting structure, such that a first distance or a second distance longer than the first distance is between each of the staplers and the corresponding anvil, wherein the two staplers staple the papers while the first distance is between each of the staplers and the corresponding anvil, and the papers are moved along a paper feeding path defined between the two staplers and the two anvils while the second distance is between each of the staplers and the corresponding anvil.

2. The stapler module according to claim 1, wherein the transmitting structure comprises:

a worm gear, connected to the motor;

a bevel gear, engaged to the worm gear;

a driving rod, connected to the bevel gear; and two connecting rod sets, respectively connected to two ends of the driving rod and respectively coupled to the two connecting parts, wherein the motor is used for driving the worm gear and the bevel gear to rotate, such that the driving rod respectively drives the two connecting parts to move toward or away from the two anvils through the two connecting rod sets while the bevel gear is rotated.

3. The stapler module according to claim 2, wherein each of the two ends of the driving rod has a spiral portion respectively corresponding to the two connecting rod sets, and each of the connecting rod sets comprises:

a first rod, having a threaded hole, wherein an end of the first rod is coupled to the corresponding spiral portion through the threaded hole, and the two first rods move away from or toward each other along an extending direction of the driving rod while the driving rod drives the two connecting parts to move toward or away from the two anvils through the two connecting rod sets respectively;

a second rod, having a first pivoting portion, a second pivoting portion, and a third pivoting portion between the first pivoting portion and the second pivoting portion, wherein the first pivoting portion and the second pivoting portion are respectively coupled to another end of the first rod and the connecting part; and a third rod, having a fourth pivoting portion, a fifth pivoting portion, and a sixth pivoting portion respectively coupled to the connecting part, the third pivoting portion, and the fixing structure.

4. The stapler module according to claim 1, wherein the fixing structure comprises a cover covering at least a part of the driving set.

5. The stapler module according to claim 1, wherein the paper feeding path is substantially vertical to a moving direction of each of the staplers.

6. A multi-function peripheral, comprising:

a main body;

a stapler module, for stapling a plurality of papers, the stapler module comprising:

a fixing structure, disposed in the main body;

a driving set, comprising:

a motor, fixed to the fixing structure;

a transmitting structure, coupled to the motor;

two connecting parts, respectively coupled to two ends of the transmitting structure;

two staplers, respectively connected to the two connecting parts; and two anvils, fixed to the fixing structure and respectively corresponding to the two staplers, the two connecting parts being driven by the motor to move toward or away from the two anvils through the transmitting structure, such that a first distance or a second distance longer than the first distance is between each of the staplers and the corresponding anvil, wherein the two staplers staple the papers while the first distance is between each of the staplers and the corresponding anvil, and the papers are moved along a paper feeding path defined between the two staplers and the two anvils while the second distance is between each of the staplers and the corresponding anvil.

7. The multi-function peripheral according to claim 6, wherein the transmitting structure comprises:

a worm gear, connected to the motor;

a bevel gear, engaged to the worm gear;

a driving rod, connected to the bevel gear; and two connecting rod sets, respectively connected to two ends of the driving rod and respectively coupled to the two connecting parts, wherein the motor is used for driving the worm gear and the bevel gear to rotate, such that the driving rod respectively drives the two connecting parts to move toward or away from the two anvils through the two connecting rod sets while the bevel gear is rotated.

8. The multi-function peripheral according to claim 7, wherein each of the two ends of the driving rod has a spiral portion respectively corresponding to the two connecting rod sets, and each of the connecting rod sets comprises:

a first rod, having a threaded hole, wherein an end of the first rod is coupled to the corresponding spiral portion through the threaded hole, the two first rods move away from or toward each other along an extending direction of the driving rod while the driving rod drives the two connecting parts to move toward or away from the two anvils through the two connecting rod sets respectively;

a second rod, having a first pivoting portion, a second pivoting portion, and a third pivoting portion between the first pivoting portion and the second pivoting portion, wherein the first pivoting portion and the second pivoting portion are respectively coupled to another end of the first rod and the connecting part; and a third rod, having a fourth pivoting portion, a fifth pivoting portion, and a sixth pivoting portion respectively coupled to the connecting part, the third pivoting portion, and the fixing structure.

9. The multi-function peripheral according to claim 6, wherein the fixing structure comprises a cover covering at least a part of the driving set.

10. The multi-function peripheral according to claim 6, wherein the paper feeding path is substantially vertical to a moving direction of each of the staplers.

* * * * *